United States Patent [19]

Pimlott et al.

[11] Patent Number: 4,668,371

[45] Date of Patent: May 26, 1987

[54] STRUCTURAL FRAME FOR AN ELECTROCHEMICAL CELL

[75] Inventors: John R. Pimlott, Sweeny; Richard N. Beaver, Angleton; Hiep D. Dang; Gregory J. E. Morris, both of Lake Jackson, all of Tex.

[73] Assignee: The Dow Chemical Company, Midland, Mich.

[21] Appl. No.: 809,373

[22] Filed: Dec. 16, 1985

[51] Int. Cl.[4] ..... C25B 9/04; C25B 11/00

[52] U.S. Cl. ..... 204/253; 204/267; 204/279; 204/286; 204/290 R; 204/290 F

[58] Field of Search ..... 204/279, 252, 253–258, 204/263–266, 267–270, 286, 290 R, 290 F

[56] References Cited

U.S. PATENT DOCUMENTS

| | | | |
|---|---|---|---|
| 3,632,498 | 1/1972 | Beer | 204/290 F |
| 3,849,279 | 11/1974 | Barkel | 204/286 X |
| 3,909,378 | 9/1975 | Walmsley | 204/98 |
| 4,025,405 | 5/1977 | Dotson et al. | 204/98 |
| 4,061,549 | 12/1977 | Hazelrigg, Jr. et al. | 204/98 |
| 4,065,366 | 12/1977 | Oda et al. | 204/98 |
| 4,116,888 | 9/1978 | Ukihashi et al. | 521/31 |
| 4,123,336 | 10/1978 | Seko et al. | 204/98 |
| 4,126,588 | 11/1978 | Ukihashi et al. | 521/31 |
| 4,142,005 | 2/1979 | Caldwell et al. | 427/126 |
| 4,151,052 | 4/1979 | Goto et al. | 204/95 |
| 4,176,215 | 11/1979 | Molnar et al. | 521/27 |
| 4,178,218 | 12/1979 | Seko | 204/98 |
| 4,192,725 | 3/1980 | Dotson et al. | 204/98 |
| 4,209,635 | 6/1980 | Munekata et al. | 560/183 |
| 4,212,713 | 7/1980 | Suhara et al. | 204/98 |
| 4,214,971 | 7/1980 | Heikel et al. | 204/290 F |
| 4,251,333 | 2/1981 | Suhara et al. | 204/98 |
| 4,270,996 | 6/1981 | Suhara et al. | 204/98 |
| 4,329,435 | 5/1982 | Kimoto et al. | 521/38 |
| 4,330,654 | 5/1982 | Ezzell et al. | 526/243 |
| 4,337,137 | 6/1982 | Ezzell | 204/252 |
| 4,337,211 | 6/1982 | Ezzell et al. | 260/456 F |
| 4,340,452 | 7/1982 | deNora | 204/129 |
| 4,340,680 | 7/1982 | Asawa et al. | 521/27 |
| 4,357,218 | 11/1982 | Seko | 204/98 |
| 4,358,412 | 11/1982 | Ezzell et al. | 260/968 |
| 4,358,545 | 11/1982 | Ezzell et al. | 521/27 |
| 4,444,632 | 4/1984 | deNora | 204/98 |
| 4,444,639 | 4/1984 | Schurig et al. | 204/257 |
| 4,444,641 | 4/1984 | Oda et al. | 204/286 |
| 4,448,662 | 5/1984 | DuBois et al. | 204/252 |
| 4,457,822 | 7/1984 | Asano et al. | 204/252 |
| 4,465,580 | 8/1984 | Kasuya | 204/290 R |
| 4,488,946 | 12/1984 | Morris et al. | 204/98 |
| 4,568,434 | 2/1986 | Morris et al. | 204/254 X |

*Primary Examiner*—Donald R. Valentine

*Attorney, Agent, or Firm*—James H. Dickerson, Jr.

[57] ABSTRACT

An electrochemical cell structure frame and cell utilizing same comprising an organic plastic member having electrically conductive inserts extending through annular shoulders on respective coplanar surfaces of the plastic member. Electrically conductive, hydraulically impermeable anolyte and catholyte resistant covers matingly contact each respective coplanar surface of the plastic member. An electrically conductive, hydraulically permeable current collector is positioned substantially coplanar with and contacts at least a portion of one of the covers. An electrically conductive, hydraulically permeable, resilient mattress is positioned substantially coplanar with and contacts at least a portion of a side of the current collector opposite the side of the current collector which contacts the cover. A catalytically active electrode is positioned substantially coplanar with and contacts at least a portion of a side of the mattress opposite the side of the mattress which contacts the current collector.

27 Claims, 1 Drawing Figure

STRUCTURAL FRAME FOR AN ELECTROCHEMICAL CELL

BACKGROUND OF THE INVENTION

This invention relates to an electrochemical cell and in particular a structural frame for use in a zero gap electrochemical cell.

It is well established that various chemicals can be produced in an electrochemical cell containing an anode and a cathode. For example, alkali metal chlorates, such as sodium chlorate, have been formed electrolytically from a sodium chloride brine in cells without a separator positioned between the anode and the cathode.

When a separator, such as a liquid permeable asbestos or polytetrafluoroethylene diaphragm or a substantially liquid impervious ion exchange membrane, is used in a cell to electrolyze a sodium chloride brine, the electrochemical products will normally be gaseous chlorine, hydrogen gas and an aqueous solution containing sodium hydroxide.

For a number of years gaseous chlorine was produced in electrochemical cells wherein an asbestos diaphragm was interposed between finger-like, anodes and cathodes which were interleaved together. During the past several years it has become apparent that the use of a substantially liquid impermeable cation exchange membrane may be preferable to the more well established diaphragm in instances where a higher purity, for example a lower sodium chloride content, higher sodium hydroxide product is desired. It was found to be more convenient to fabricate ion exchange type electrochemical cells from relatively flat or planar sheets of ion exchange membrane rather than to interleave the membrane between the anode and cathode within the older finger-like cells used with asbestos diaphragms.

The newer, so-called flat plate electrochemical cells using a planar piece of ion exchange membrane to separate the anolyte from catholyte compartments also have a plurality of solid, liquid impervious frames adapted to support the anode on one side and the cathode on the opposite side. These frames have previously been constructed of materials such as metal and plastic, but neither of these materials has been found to be entirely satisfactory. In any electrochemical cell, including both monopolar and bipolar cells, there is a possibility that electrolyte may leak from within the cell to the exterior. In instances where such leakage has occurred in cells with iron or other ferrous type frames, it was found that the iron frame corroded or was itself electrolytically attacked. Plastic frames are not generally subject to the electrochemical attack, but are normally not resistant to the anolyte and/or catholyte within the cell under operating conditions for extended periods of time, for example, several years.

It is desired to provide a structural frame for use in zero gap electrochemical cells which would minimize the corrosion problems and would increase the relatively short useful life attendant with those frames used by the prior art.

SUMMARY OF THE INVENTION

The present invention is a structural frame adapted for use in an electrochemical cell. The frame comprises an organic plastic member with a plurality of horizontally and vertically spaced-apart shoulders protruding outwardly from opposing generally coplanar anolyte and catholyte surfaces of the plastic member. Each of the shoulders annularly encircles and supports an electrically conductive insert extending from an exterior face of a shoulder on the catholyte surface of the plastic member, through the plastic member, to an exterior face of a shoulder on the anolyte surface of the plastic member.

An electrically conductive, substantially completely hydraulically impermeable anolyte cover is matingly contacted with the anolyte surface of the plastic member and adapted to minimize contact between the anolyte and the plastic member within the cell. The anolyte cover is resistant to the corrosive effects of the anolyte. An electrically conductive, substantially completely hydraulically impermeable catholyte cover is matingly contacted with the catholyte surface of the plastic member and adapted to minimize contact between the catholyte and the plastic member within the cell. The catholyte cover is resistant to the corrosive effects of the catholyte. Both the anolyte cover and the catholyte cover may be made from a metal, or, optionally made from another material and have metallic inserts molded in at the points where they contact the metallic inserts which pass through the plastic member.

An electrically conductive, hydraulically permeable current collector is positioned substantially coplanar with and contacts at least a portion of one of the covers. An electrically conductive, hydraulically permeable, resilient mattress is positioned substantially coplanar with and contacts at least a portion of a side of the current collector opposite the side of the current collector which contacts the cover. A catalytically active electrode is positioned substantially coplanar with and contacts at least a portion of a side of the mattress opposite the side of the mattress which contacts the current collector.

The invention further includes an electrochemical cell utilizing a plurality of the above described structural frames removably and sealably positioned in a generally coplanar relationship with each other and with each of the plastic members being spaced apart at least by an anode on one side of the plastic member and a cathode on an opposing side of the plastic member.

DESCRIPTION OF THE DRAWINGS

The accompanying FIGURE further illustrates the invention;

In the FIGURE is depicted an exploded, sectional side view of the cell structure used in forming a zero gap bipolar electrode cell unit.

DESCRIPTION OF THE PREFERRED EMBODIMENTS

Figure 1:
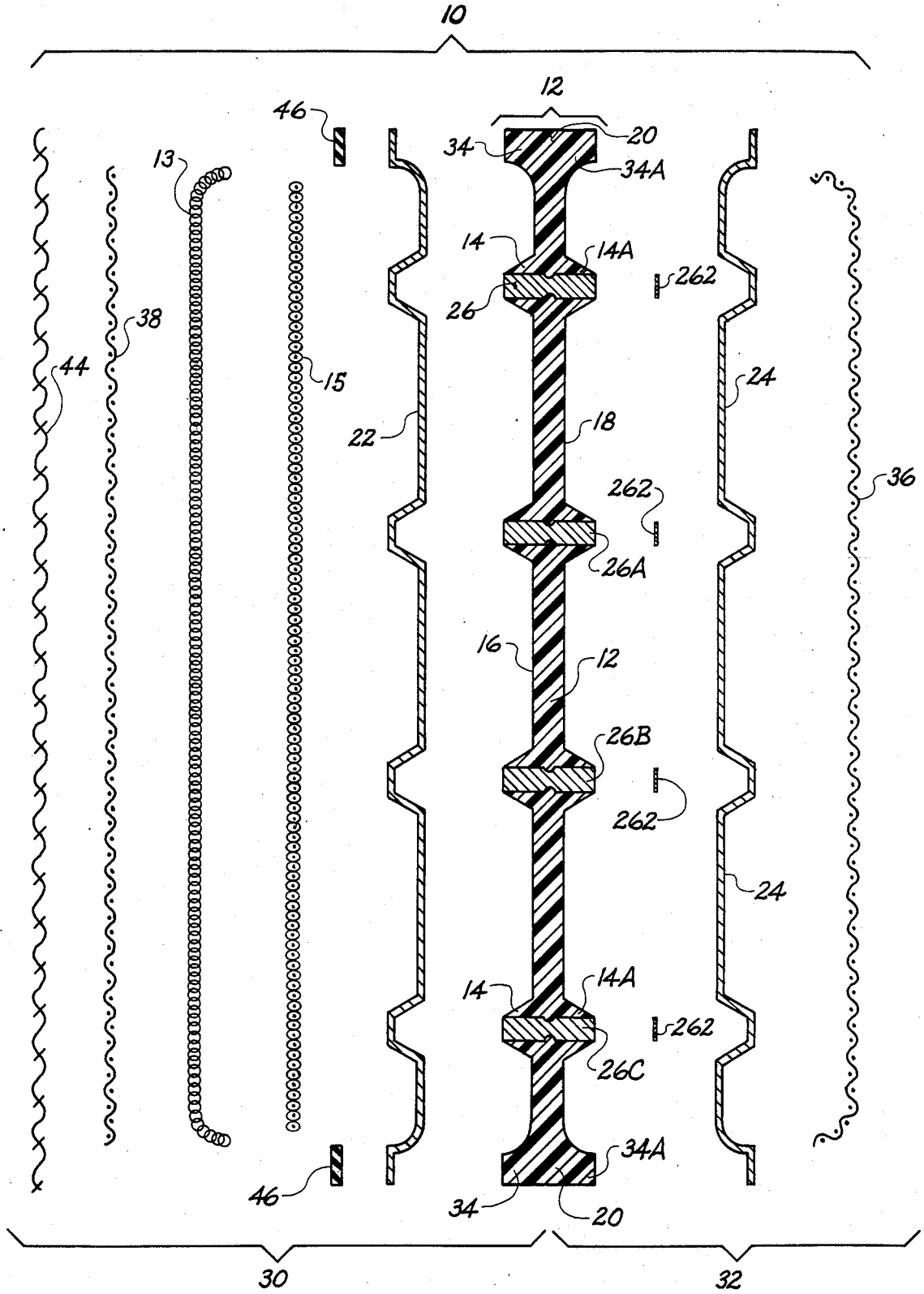

The present invention is a zero gap cell. A zero gap cell is one in which at least one electrode is in physical contact with the ion exchange membrane but is not embedded into or bonded to the membrane. Optionally, both electrodes may be in physical contact with the ion exchange membrane. Such cells are illustrated in, for example, U.S. Pat. Nos. 4,444,639; 4,457,822; and 4,448,662. These patents are incorporated by reference for the purposes of the zero gap cells that they illustrate.

In the FIGURE is shown structural frame 10 which achieves the above objects, adapted for use in an electrochemical cell for producing gaseous chlorine in aqueous alkali metal hydroxide solution. Although the present invention can be beneficially employed to produce chlorine and various alkali metal hydroxide solutions, it is preferred to use sodium chloride as the primary salt in the starting brine since this particular salt is readily available commercially and there are many well established uses for sodium hydroxide produced electrolytically.

The cell structure 10 includes a generally planar organic plastic member 12 has a shape with a plurality of horizontally and vertically spaced apart shoulders 14 and 14*a* protruding outwardly from catholyte surface 16 and from anolyte surface 18 into the catholyte chamber 30 and into the anolyte chamber 32, respectively. The peripheral surface 20 of the plastic member 12 defines the outer surface of the electrochemical cell when a plurality of the plastic members are positioned together. The peripheral configuration of the plastic members 12 is optional and can be varied to suit the particular configuration of the electrochemical cell shape desired.

The number, the size and the shape of the shoulders may be an important consideration in both the design and operation of the present invention. They may be square, rectangular, conical, cylindrical, or any other convenient shape when viewed in sections taken either parallel or perpendicular to the central portion. The shoulders may have an elongated shape to form a series of spaced ribs distributed over the surface of the plastic member.

A number of plastic materials are suitable for use in the present invention. Without intending to be limited by the specific organic materials hereinafter delineated, examples of such suitable materials include polyethylene; polypropylene; polyvinylchloride; chlorinated polyvinyl chloride; acrylonitrile, polystyrene, polysulfone, styrene acrylonitrile, butadiene and styrene copolymers; epoxy; vinyl esters; polyesters; and fluoroplastics and copolymers thereof. It is preferred that a material such as polypropylene be used for the structural member since it produces a shape with adequate structural integrity at elevated temperatures, is readily available and is relatively inexpensive with respect to other suitable materials.

It is surprising that the plastic member 12 can be produced by any of a number of processes known well to those skilled in the art of plastic molding. Such molding processes include, for example, injection molding, compression molding, transfer molding, and casting. Of these processes, injection molding has been found to satisfactorily produce a structure with adequate strength for use in an electrochemical cell. The ease of molding relatively complex shapes and the strength of the finished injection molded article contribute to making this process preferred for making the herein described structural member. Preferably, the plastic is injected into a mold containing the desired number of inserts. In this manner, the plastic member is a one-piece member which fits tightly around the inserts, holds them in place, and provides a high degree of support to them. Such a configuration minimizes the likelihood that the inserts will separate from the plastic member and become loose. The ease of molding relatively complex shapes and the strength of the finished injection molded article contribute to making this process preferred for making the herein described structural member. This is a considerable advantage over the prior art where the plastic frame was molded first and then the electrical conductors were subsequently installed.

When the plastic member 12 is employed in an electrochemical cell for producing chlorine, the temperature of the cell and the plastic member will frequently reach, or be maintained at, temperatures of from about 60° to about 90° Celsius. At these temperatures plastics, as do most materials, expand a measurable amount. Any expansion and later contraction on cooling of the plastic frame could result in electrolyte seeping from within the plurality of cells when joined together or, more importantly, could result in difficulties, or more importantly, could result in distortion of the anode and cathode which are made of metallic expanded mesh or perforated sheets. Furthermore, the differential expansion between the plastic frame 22 and the catholyte cover 22 and anolyte cover 24 would create stress on the welds which affix these covers to the inserts which are themselves molded in the plastic frame. If however, the covers are themselves made of a plastic material, this expansion problem is minimized.

To reduce, and preferably minimize, the difference in expansion between the covers 22 and 24 and the plastic member 12, it is preferred to incorporate an additive to reduce thermally induced expansion of the plastic member. More preferably, the additive will also increase the structural strength of the finished plastic article. Such additive can be, for example, fiberglass, graphite fibers, carbon fibers, talc, glass beads, pulverized mica, asbestos, and the like, and combinations thereof. It is preferred that the plastic contain from about 5 to about 75 weight percent and more preferably from about 10 to about 40 weight percent of the additive. Glass fibers can be readily mixed with polypropylene to produce an injectable material suitable for use in the present invention which results in a solid, physically strong body with a coefficient of expansion less than polypropylene not containing glass fibers. Of greater importance is the need to minimize the difference in expansion between the plastic member, the electrodes, and the current collector, since these elements are welded together and it is critical that they remain substantially flat and parallel.

It has been determined that the use of commercially available polypropylene which has been specially formulated to afford bonding with the glass works particularly well. This results in a composite having a lower coefficient expansion than a mixture of polypropylene and glass fibers. Such chemically-combined glass fiber reinforced polypropylene is available from, for example, Hercules, Inc., Wilmington, Del., as Pro-fax PC072 polypropylene.

At least one electric conducting element, such as inserts 26, 26A, 26B, and 26C, is positioned and preferably molded into the plastic member 12. The inserts 26, 26A, 26B, and 26C each extend through the plastic member from the catholyte surface 16 to the anolyte surface 18. The inserts 26, 26A, 26B, and 26C are preferably retained within the plastic member 12 by means of friction between the plastic and the insert. It is more preferable to increase the friction between these two bodies by having an additional means to restrain the insert within the plastic. Such additional means include, for example grooves (one or more) around the circumference of the insert(s), keys welded to the insert, hole(s) extending into and/or through the insert, slots, rings, collars, studs, or bosses.

The inserts 26, 26A, 26B, and 26C can be made of any material which will permit flow of an electric current between the catholyte cover 22 and the anolyte cover 24. Since the covers 22 and 24 are preferably metallic, it is convenient to fabricate the insert from a metal, such as aluminum, copper, iron, steel, nickel, titanium and the like, or alloys or physical combinations including such metals.

The shoulders and inserts are preferably spaced so they provide a somewhat uniform and low electrical potential gradient across the face of the electrode to which they are attached. They are preferably spaced so that they allow free fluid circulation from any unoccupied point within their respective electrolyte compartment to any other unoccupied point within that compartment. Thus the shoulders will be fairly uniformly spaced apart from one another in their respective compartments.

To improve the flow of DC electric current between the covers 22 and 24, the inserts 26, 26A, 26B, and 26C are preferably made of a material weldably compatible with the particular cover it contacts. For example, the insert 26 may be a welded assembly of a steel rod with a vanadium disk 262 interposed between and welded to both the rod and a titanium member 262 on the anolyte surface 18. The titanium member 262 is then readily weldable to titanium anolyte cover 24.

To prevent catholyte from contacting the plastic member within the electrochemical cell and cause deterioration of the plastic and/or leakage of electrolyte between the plastic and the insert 26 from cathode compartment 30 to anode compartment 32 the cover 22 is matingly contacted with the catholyte surface 16 and the anolyte cover 24 is matingly contacted with the anolyte surface 18. As shown in the FIGURE, both the anolyte and the catholyte covers are so shaped to correspond closely to the exterior surface of the plastic member 12. The degree of correspondence may be more or less than illustrated in the FIGURE. In some instances, the electrode compartment covers 22 or 24 may abut the frame 10 in one or more locations. It is important that the portions of both of the covers 22 and 24 which are exposed to the anolyte or catholyte and span the plastic member contain no openings through which electrolyte or electrochemical products can pass during operation of the electrochemical cell. The freedom from openings through the covers minimizes the likelihood that electrolyte will leak or seep through holes or spaces around gaskets of other seals and come into contact with the plastic member.

The anolyte cover 24 is made of a material which is resistant to the anolyte during operation of the cell. Normally, this material is not electrolytically active, but the invention is still operable if the material does become or is active electrolytically. Suitable materials are, for example, titanium, tantalum, zirconium, tungsten and other valve metals not materially affected by the anolyte. Titanium is preferred as the anolyte cover.

The catholyte cover 22 is resistant to attack by the catholyte under the conditions present in the electrochemical cell. Suitable materials for the catholyte cover include, for example, iron, steel, stainless steel, nickel, lead, molybdenum, and cobalt and alloys, including major portions of these metals. Nickel, including nickel base alloys, is preferably the catholyte cover, since nickel and nickel alloys are generally resistant to the corrosive effects of the catholyte, especially an aqueous catholyte solution containing up to at least about 35 weight percent sodium hydroxide. Steel has also been found to be suitable, and relatively inexpensive, for use in a cell as a catholyte cover in the presence of a dilute (i.e., up to about 22 weight percent) aqueous solution of sodium hydroxide.

To assist in assembling a plurality of the structural frames 10 into an electrochemical cell it is desirable, although not essential, to have flanges 34 and 34*a* extending outwardly from the main structural portion of the plastic member 12 along the periphery of such member. In a preferred embodiment the flanges extend outwardly from the plastic member about the same distance as the inserts 26, 26A, 26B, and 26C. Alternatively, but not preferred, separate spacer elements (not shown) could be utilized to build up the plastic member 12 sufficiently to permit a number of the plastic members to be combined into a cell series without having electrolyte, either anolyte or catholyte, leak from within the catholyte and anolyte compartments 30 and 32, respectively, to an exterior portion of the cell.

The FIGURE further shows an anode 36, which is positively charged during operation of the cell from an external power source (not shown). During operation of the cell, the anode 36 is electrically connected to the anolyte cover 24. Such electrical connection is readily achieved by welding the anode 36 to the anode cover where the anode cover comes into physical contact with the inserts 26, 26A, 26B, and 26C. For improved electrical contact, the anolyte cover 24 is welded to the inserts 26, 26A, 26B, and 26C and the anode 36 is welded to the anolyte cover 24 adjacent to the inserts 26, 26A, 26B, and 26C.

Various means of welding can be utilized in the present invention, but it has been found highly satisfactory to use resistance or capacitance discharge welding techniques. Other suitable welding techniques include tungsten inert gas (TIG) and metal inert gas (MIG) welding. This welding serves a primary purpose of retaining the anode in position and not for electrical flow, although electric current will naturally pass through the welded areas.

The anode 36 is preferably a metal, such as one of the common film-forming metals, which is resistant to the corrosive effects of the anolyte during the operation of the cell. Suitable metals are well known to include tantalum, tungsten, columbium, zirconium, molybdenum, and preferably, titanium and alloys containing major amounts of these metals, coated with an activating substance, for example, an oxide of a platinum group metals, such as ruthenium, iridium, rhodium, platinum, palladium, either alone or in combination with an oxide of a film-forming metal. Other suitable activating oxides include cobalt oxide either along or in combination with other metal oxides. Examples of such activating oxides are found in U.S. Pat. Nos. 3,632,498; 4,142,005; 4,061,549; and 4,214,971.

The cathode 38 which has a negative electric potential during operation of the cell, is electrically connected to the catholyte cover 22 through mattress 13 and current collector 15. The cathode 38 is preferably constructed of a material which is resistant to the corrosive effects of the catholyte during operation of the cell. Materials suitable for contact with the catholyte will depend upon the concentration of the alkali metal hydroxide in the aqueous solution and may be readily determined by one skilled in the art. Generally, however, materials such as iron, nickel, lead, molybdenum, cobalt, and alloys including major amounts of these metals, such as low carbon stainless steel, are suitable for use as the cathode. The cathodic electrodes may optionally be coated with an activating substance to improve performance of the cell. For example, a nickel substrate could be coated with oxides of nickel and a platinum group metal, such as, ruthenium, or nickel and a platinum group metal, or oxide thereof such as ruthenium oxide, to reduce hydrogen overvoltage. U.S. Pat. No. 4,465,580 describes the use of such cathodes.

The current collector 15 is contacted with the flattened ends of the catholyte cover 22 and with the mattress 13. Current collectors are illustrated in, for example, U.S. Pat. No. 4,444,641. That patent is hereby incorporated by reference for the purposes of its teaching about current collectors.

The mattress 13 is contacted with cathode 38. The mattress structure, for example a mattress taught in U.S. Pat. No. 4,444,632, may be used to hold the ion exchange membrane and one of the electrodes in physical contact. Other mattress configurations are illustrated in U.S. Pat. No. 4,340,452. These patents are incorporated by reference for the purposes of the cell elements that they teach.

It should be understood that the mattress 13 and the current collector 15 could be on the anode side or could be on both the anode side and the cathode side.

As is apparent from the FIGURE, both the anode 36 and the cathode 38 are permeable to the respective electrolyte. The electrodes can be made permeable by several means including, for example, using a punched sheet or plate, an expanded mesh, or woven wire. The anode is preferably sufficiently porous to permit anolyte and chlorine to pass therethrough and the cathode are preferably sufficiently porous to permit catholyte and hydrogen to pass therethrough.

The electrochemical cell illustrated in the FIGURE also shows an ion exchange membrane 44 which is in contact with the anode 36 and the cathode 38 when a plurality of such cells are assembled in operable combination. When a plurality of the units shown in the FIGURE are stacked and adjacent to each other in operable combination, the membrane could be in contact with the cathode 38 or be suspended between the two electrodes. It is important, that the ion exchange membrane 44 separate the anode compartment 32 from the cathode compartment of adjacent units.

Cation exchange membranes are well known to contain fixed anionic groups that permit intrusion and exchange of cations, and exclude ions, from an external source. Generally the membrane has a matrix of a cross-linked polymer, to which are attached charged radicals such as $-SO_3(-1)$, $-COO(-1)$, $-PO_3(-2)$, $HPO_2(-1)$, $-AsO_3(-2)$, and $SeO_3(-1)$. Vinyl addition polymers and condensation polymers may be employed. The polymer can be, for example, styrene, divinyl benzene, polyethylene and fluorocarbons. Condensation polymers are, for example, phenol sulfuric acid, and formaldehyde resins. Representative of the types of permselective membranes envisioned for use with this invention are those disclosed in the following U.S. Pat. Nos.: 3,909,378; 4,025,405; 4,065,366; 4,116,888; 4,123,336; 4,126,588; 4,151,052; 4,176,215; 4,178,218; 4,192,725; 4,209,635; 4,212,713; 4,251,333; 4,270,996; 4,329,435; 4,330,654; 4,337,137; 4,337,211; 4,340,680; 4,357,218; 4,358,412; and 4,358,545. These patents are hereby incorporated by reference for the purpose of the membranes they disclose.

To minimize leakage of electrolyte from the cell after assembling a number of the structural frames 10 together, at least one gasket 46 is positioned between adjoining frames when a plurality of frames are stacked adjacent to each other in operable combination (now shown). During assembly of a plurality of the frames, a compressive force is applied to the extremes of the frames to compress the gasket material 46 so that it both seals the ion exchange membrane 44 in position and minimizes leakage of electrolyte from within the final cell series to the exterior of the cells. Preferably, the membrane 44 is positioned to substantially entirely prevent leakage of electrolyte from within the final cell series to the exterior of the cells. Various gaskets materials can be used including, for example, fluorocarbon, chlorinated polyethylene rubber, and ethylene propylene diene terpolymer rubber.

In operating the cell series as an electrolysis cell series for NaCl brine, certain operating conditions are preferred. In the anode compartment a pH of from about 0.5 to about 5.0 is desired to be maintained. The feed brine preferably contains only minor amounts of multivalent cations (less than about 80 parts per billion when expressed as calcium). More multivalent cation concentration is tolerated with the same beneficial results if the feed brine contains carbon dioxide in concentrations lower than about 70 ppm when the pH of the feed brine is lower than 3.5.

Operating temperatures can range from about 0° to about 110° C., but preferably from about 60° C. to about 80° C. Brine purified from multivalent cations by ion-exchange resins after conventional brine treatment has occurred is particularly useful in prolonging the life of the membrane. A low iron content in the feed brine is desired to prolong the life of the membrane. Preferably the pH of the brine feed is maintained at a pH below 4.0 by the addition of hydrochloric acid.

Preferably the pressure in the cathode compartment is maintained at a pressure slightly greater than that in the anode compartment, but preferably at a pressure difference which is no greater than a head pressure of about 1 foot of water. Preferably the operating pressure is maintained at less than 7 atmospheres.

Usually the cell is operated at a current density of from about 1.0 to about 4.0 amperes per square inch, but in some cases operating above 4.0 amps/in. is quite acceptable.

We claim:

1. A structural frame adapted for use in an electrochemical cell comprising:

an organic plastic member with a plurality of horizontally and vertically spaced-apart shoulders protruding outwardly from opposing generally coplanar anolyte and catholyte surfaces of said plastic member;

at least one electrically conductive insert extending from an exterior face of a shoulder on the catholyte surface of the plastic member, through the plastic member, to an exterior face of a shoulder on the anolyte surface of the plastic member, wherein each of said shoulders annularly encircles and supports each of said inserts;

an electrically conductive, substantially completely hydraulically impermeable anolyte cover resistant to the corrosive effects of an anolyte matingly contacted with the anolyte surface of said plastic member and adapted to minimize contact between the anolyte and said plastic member within the cell;

an electrically, substantially completely hydraulically impermeable conductive catholyte cover resistant to the corrosive effects of a catholyte matingly contacted with the catholyte surface of said plastic member and adapted to minimize contact between the catholyte and said plastic within the cell;

an electrically, conductive, hydraulically permeable current collector substantially coplanar with and contacting at least a portion of one of the covers;

an electrically conductive, hydraulically permeable resilient mattress substantially coplanar with and contacting at least a portion of a side of the current collector opposite the side of the current collector which contacts the cover; and a catalytically active electrode positioned substantially coplanar with and contacting at least a portion of a side of the mattress opposite the side of the mattress which contacts the current collector.

2. The frame of claim 1 wherein the anolyte cover is a metal selected from the group consisting of titanium, tantalum, zirconium, tungsten, and alloys thereof.

3. The frame of claim 1 wherein the catholyte cover is a metal selected from the group consisting of iron, steel, stainless steel, nickel, lead, molybdenum, cobalt, and alloys thereof.

4. The frame of claim 1 wherein the insert is a metal selected from the group consisting of aluminum, copper, iron, steel, nickel, titanium, and alloys thereof.

5. The frame of claim 1 wherein said anolyte and catholyte covers are attached directly to said insert.

6. The frame of claim 1 wherein the anolyte cover is titanium, or an alloy thereof;

at least a portion of said inserts are composed of a ferrous-containing material; and said cover is attached, by welding, to at least a portion of said ferrous-containing inserts through an intermediate metal which is weldable compatible with said titanium cover and said ferrous-containing insert.

7. The frame of claim 1 wherein the plastic is selected from the group consisting of polyethylene, polypropylene, polyvinylchloride, chlorinated polyvinylchloride, acrylonitrile, butadiene and styrene copolymers, epoxy, vinyl esters, polyesters and fluoroplastics.

8. The frame of claim 1 wherein the plastic contains an additive selected from the group consisting of fiberglass, graphite fibers, talc, glass beads and pulverized mica.

9. The frame of claim 8 wherein the plastic contains from about 5 to about 75 weight percent of the additive.

10. The frame of claim 1 wherein the plastic contains an additive to reduce thermally induced expansion of said plastic member.

11. The frame of claim 1 wherein said plastic member has a peripheral flange extending outwardly from the anolyte and the catholyte surfaces of said plastic member.

12. The frame of claim 11 wherein the flange extends outwardly from the plastic member about the same distance as said insert.

13. An electrochemical cell comprising:

a plurality of the structural frames of claim 1 removable and sealably positioned in a generally coplanar relationship with each other and each of said plastic members being spaced apart by an anode on one side of each of said frames and a cathode on an opposing side of each of said frames.

14. The cell of claim 13 wherein each of said anolyte and catholyte covers are welded to at least a portion of said inserts said anode and said cathode are welded to the respective covers at locations adjacent to said inserts.

15. The cell of claim 14 wherein the plastic is selected from the group consisting of polyethylene, polypropylene, polyvinylchloride, chlorinated polyvinylchloride, acrylonitrile, butadiene and styrene copolymers, epoxy, vinyl esters, polyesters and fluoroplastics.

16. The cell of claim 14 wherein the plastic contains an additive selected from the group consisting of fiberglass, graphite fibers, talc, glass beads and pulverized mica.

17. The cell of claim 16 wherein the plastic contains from about 5 to about 75 weight percent of the additive.

18. The cell of claim 16 wherein said plastic member has a peripheral flange extending outwardly from the anolyte and the catholyte surfaces of the plastic member.

19. The cell of claim 13 wherein the anolyte cover is selected from the group of materials consisting of titanium, tantalum, zirconium and tungsten.

20. The cell of claim 13 wherein the catholyte cover is selected from the group of materials consisting of iron, steel, stainless steel, nickel, lead, molybdenum, cobalt, and alloys thereof.

21. The cell of claim 13 wherein the insert is selected from the group of materials consisting of aluminum, copper, iron, steel, nickel, titanium, and alloys thereof.

22. The cell of claim 13 wherein said anolyte and catholyte covers are welded directly to said insert.

23. The cell of claim 13 wherein the anolyte cover is titanium or an alloy thereof, said insert is a ferrous-containing material and a vanadium disk is positioned between, and welded to, said anolyte cover and said insert.

24. The cell of claim 13 wherein the plastic contains an additive to reduce thermally induced expansion of said plastic member.

25. The cell of claim 13 wherein said plastic member has a peripheral flange extending outwardly from the anolyte and the catholyte surfaces of said plastic member.

26. The cell of claim 26 wherein the flange extends outwardly from the plastic member about the same distance as said inserts.

27. A structural frame adapted for use in a chlor-alkali electrochemical cell for producing gaseous chlorine and an aqueous alkali metal hydroxide solution from an aqueous alkali metal chlorine brine comprising:

a glass filled polypropylene member a plurality of horizontally and vertically spaced-apart shoulders protruding outwardly from opposing generally coplanar anolyte and catholyte surfaces of said polypropylene member;

at least one electrically conductive steel insert extending from an exterior face of a shoulder on the catholyte surface of the polypropylene member, through said polypropylene member, to an exterior face of a shoulder on the anolyte surface of the polypropylene member, wherein each of said shoulders annularly encircles and supports each of said inserts;

a substantially completely hydraulically impermeable titanium anolyte cover matingly contacted with the anolyte surface of said polypropylene member and adapted to minimize contact between an anolyte and said polypropylene member within the cell;

a substantially completely hydraulically impermeable nickel catholyte cover matingly contacted with the catholyte surface of said polypropylene member and adapted to minimize contact between a catholyte and said polypropylene within the cell;

an electrically, conductive, hydraulically permeable current collector substantially coplanar with and contacting at least a portion of one of the covers;

an electrically conductive, hydraulically permeable resilient mattress substantially coplanar with and contacting at least a portion of a side of the current collector opposite the side of the current collector which contacts the cover; and a catalytically active electrode positioned substantially coplanar with and contacting at least a portion of a side of the mattress opposite the side of the mattress which contacts the current collector.

* * * * *